United States Patent [19]

Killy

[11] 4,130,235

[45] Dec. 19, 1978

[54] ONE-PIECE CARRIER PARTITION

[75] Inventor: Earl J. Killy, Monroe, La.

[73] Assignee: Olinkraft, Inc., Monroe, La.

[21] Appl. No.: 792,787

[22] Filed: May 2, 1977

[51] Int. Cl.[2] ..... B65D 81/08; B65D 5/48

[52] U.S. Cl. ..... 229/15; 229/28 BC; 229/42

[58] Field of Search ..... 229/15, 42, 28 R; 217/22, 23

[56] References Cited

U.S. PATENT DOCUMENTS

| | | | |
|---|---|---|---|
| 2,593,092 | 4/1952 | Bergstein | 229/42 |
| 3,248,036 | 4/1966 | Weiss | 229/15 |
| 3,260,440 | 7/1966 | Foley | 229/15 |
| 3,301,460 | 1/1967 | Harrison | 229/15 |
| 3,416,653 | 12/1968 | Farquhar | 206/139 |
| 3,682,367 | 8/1972 | Rohde et al. | 229/28 X |
| 3,756,496 | 9/1973 | Oostdik | 229/15 |
| 3,767,106 | 10/1973 | Morgan | 217/22 X |
| 3,921,891 | 11/1975 | Gorham | 229/28 R X |

*Primary Examiner*—Davis T. Moorhead
*Attorney, Agent, or Firm*—O'Brien and Marks

[57] ABSTRACT

A one-piece partition has front and back series of hinged panels folded together wherein the panels of each series have alternating short and tall heights. The short panels of one series correspond to the tall panels of the opposite series. The end panels of one series is connected at a scoreline to the end panels of the opposite series while a pair of adjacent panels intermediate the end panels of one series is separated by a cut line from the corresponding pair of adjacent panels of the opposite series so that the pairs of adjacent panels may be folded outward to form wings of the partition.

7 Claims, 6 Drawing Figures

ONE-PIECE CARRIER PARTITION

BACKGROUND OF THE INVENTION

1. Field of the Invention

This invention relates to paperboard partitions for multiple article carriers.

2. Description of the Prior Art

The prior art as exemplified in U.S. Pat. No. 3,248,036, No. 3,416,653 and No. 3,682,367, contains a number of one-piece partitions for multiple article carriers wherein a blank having front and back series of panels is folded longitudinally and intermediate pairs of panels on each half are reversely folded frontward and backward to form flanges of the partition. However, these prior art partitions form a double wall thickness the full height of the partition members resulting in excessive paperboard and costs of the partition.

SUMMARY OF THE INVENTION

The invention is summarized in a one-piece partition for a multiple article carrier including front and back series of panels, each of the front and back series of panels having at least four panels hinged together at vertical scorelines, end panels of the front and back series of panels being hinged at horizontal scorelines to the respective end panels of the opposite series of panels, an adjacent pair of panels in each series of panels between the end panels being free of the corresponding adjacent pair of panels of the opposite series of panels, and the front and back series of panels having respective alternating tall and short vertical dimensions wherein the corresponding panel of the opposite series to each tall panel is short.

An object of the invention is to construct a one-piece carrier partition which minimizes the amount of paperboard necessary to form the partition.

It is also an object of the invention to construct a one-piece carrier partition which can be selectively inverted to provide a double wall thickness between either the lower portions of the upper portions of articles in a carrier.

One advantage of the invention is that there is substantially no waste paperboard when cutting the partitions.

Other objects, advantages and features of the invention will be apparent from the following description of the preferred embodiment taken in conjunction with the accompanying drawings.

DESCRIPTION OF THE PREFERRED EMBODIMENT

Figure 6:
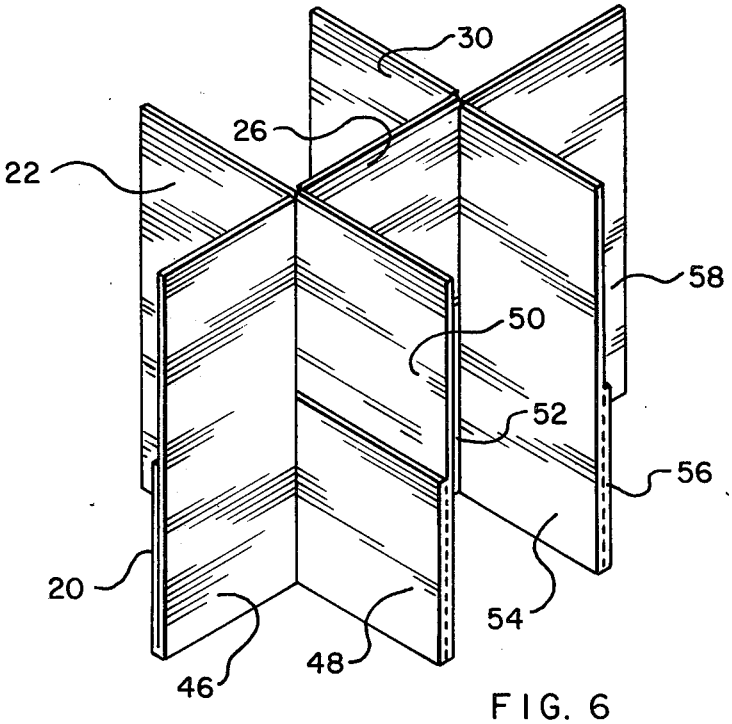
FIG. 6 is a perspective view of the completely opened one-piece divider of FIG. 5.

As illustrated in FIG. 6, the invention is embodied in a divider for separating a plurality of articles, such as bottles, in a carrier or the like.

Figure 2:
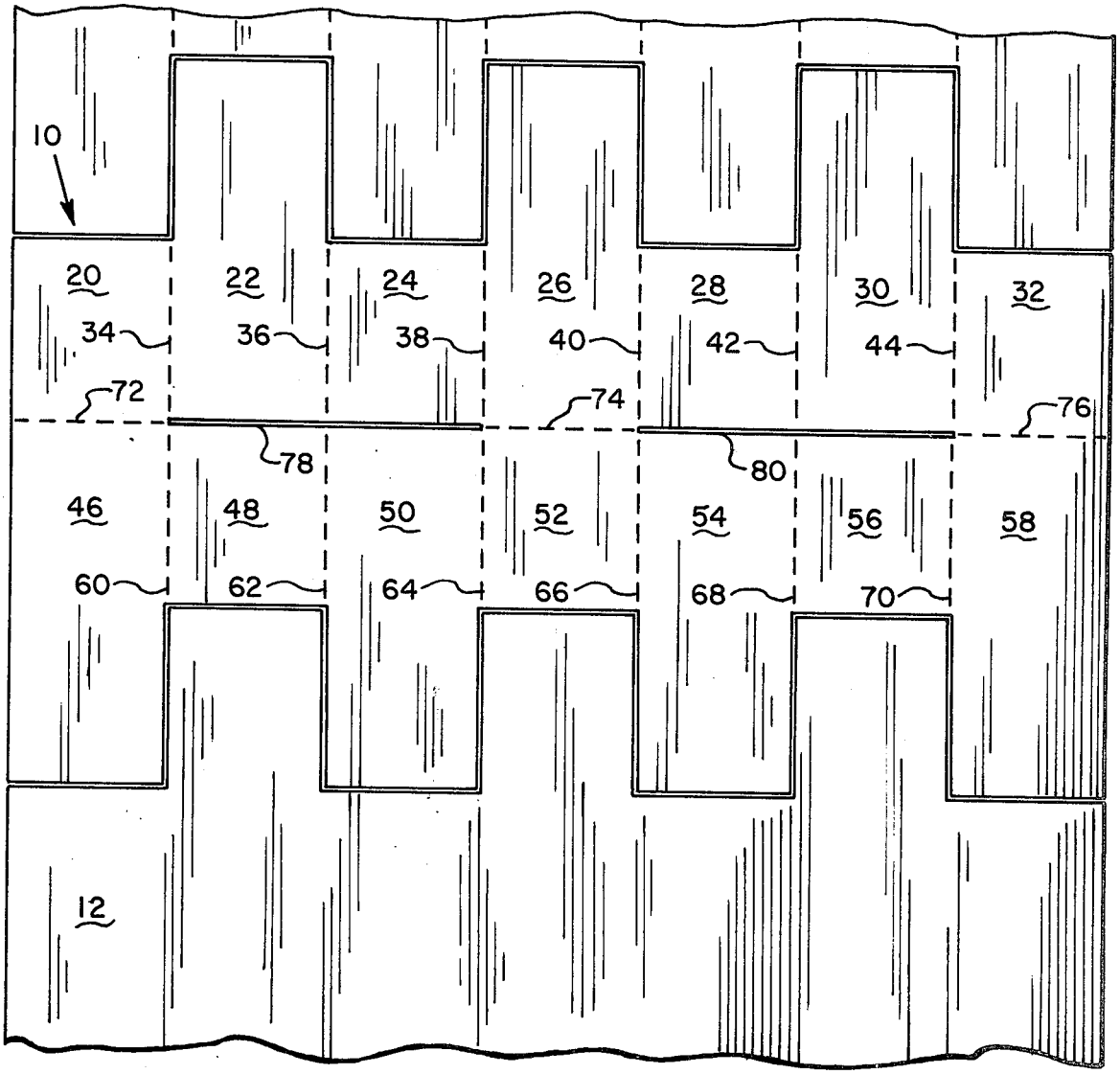
FIG. 2 is a plan view of the blank of FIG. 1 in an unfolded condition being cut from a paperboard strip.

The divider is formed from a single piece blank indicated generally at 10 in FIG. 2 cut from a continuous strip 12 of paperboard. The blank 10 includes a rear series of divider panels 20, 22, 24, 26, 28, 30 and 32 interconnected by vertical hinges or perforated scorelines 34, 36, 38, 40, 42, and 44 and a front series of panels 46, 48, 50, 52, 54, 56 and 58 interconnected by vertical hinges or perforated scorelines 60, 62, 64, 66, 68, and 70. One end pair of panels 20 and 46 are interconnected by a horizontal hinge or scoreline 72, the middle pair of panels 26 and 52 are interconnected by a horizontal hinge or scoreline 74, and the other end pair of panels 32 and 58 are interconnected by a horizontal hinge or scoreline 76. A cut 78 separates the pair of adjacent panels 22 and 24 in the rear series from the corresponding adjacent pair of panels 48 and 50 in the front series while a cut 80 separates the adjacent pair of panels 28 and 30 in the rear series from the corresponding adjacent pair of panels 54 and 56 in the front series. The scorelines 72, 74 and 76 and the cuts 78 and 80 define a straight center line of the divider or partition blank. The panels 20, 22, 24, 26, 28, 30, 32, 46, 48, 50, 52, 54, 56 and 58 have inner edges extending along this center line. The series of panels 20, 22, 24, 26, 28, 30 and 32 have alternating short and tall vertical dimensions while the series of panels 46, 48, 50, 52, 54, 56 and 58 have alternating tall and short vertical dimensions; the short panels 20, 24, 28 and 32 of the rear series corresponding to the tall panels 46, 50, 54 and 58 of the front series while the tall panels 22, 26 and 30 of the rear series correspond to the short panels 48, 52 and 56 of the front series. The vertical dimension of the short panels is about one-half of the vertical dimension of the tall panels.

It is noted that the corresponding panels in the rear and front series form elongated panel pairs, i.e. pair 20 and 46, pair 22 and 48, pair 24 and 50, pair 26 and 52, pair 28 and 54, pair 30 and 56 and pair 32 and 58, which are of equal length and are offset by about one-third their length from the adjoining panel pair or pairs.

Figure 1:
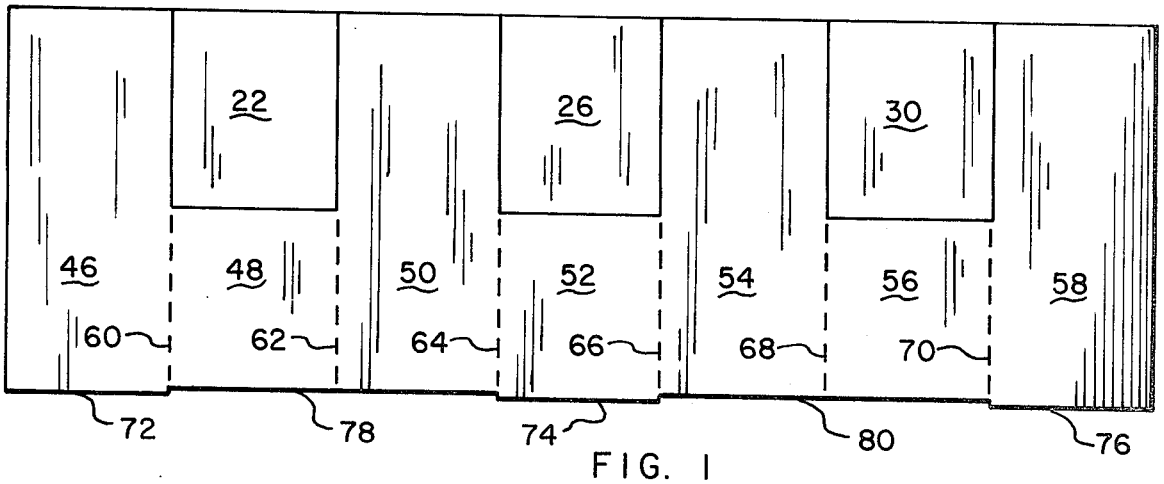
FIG. 1 is a plan view of a flat longitudinally folded one-piece blank for forming a divider in accordance with the invention.
Figure 3:
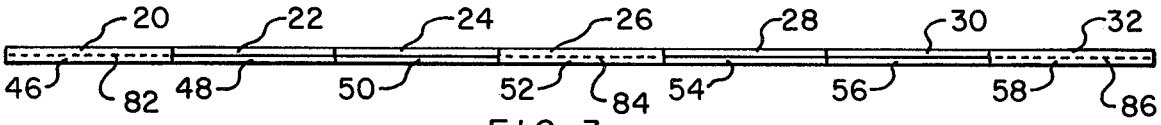
FIG. 3 is a cross-section view of the flat folded divider blank of FIG. 1.

In forming the divider of FIG. 6, the blank is first folded longitudinally as shown in FIGS. 1 and 3 to bring the front and back series of panels in face to face relationship. The end pair of panels 20 and 46, the middle pair of panels 26 and 52 and the end pair of panels 32 and 58 may be bonded together by an adhesive as shown by the dotted lines 82, 84, and 86.

Figure 4:
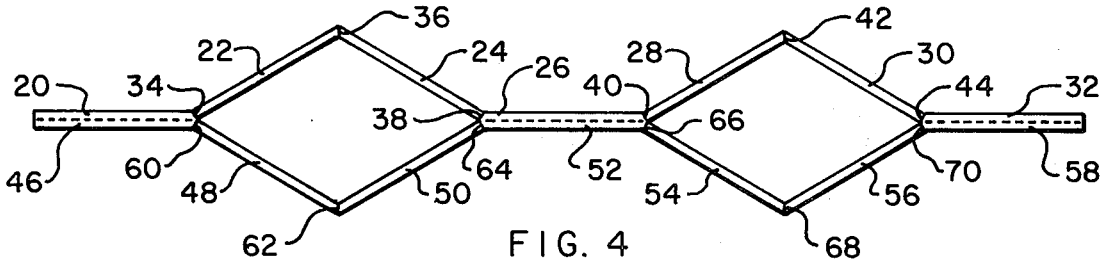
FIG. 4 is a view similar to FIG. 3 but with the divider blank being partially opened into a divider.
Figure 5:
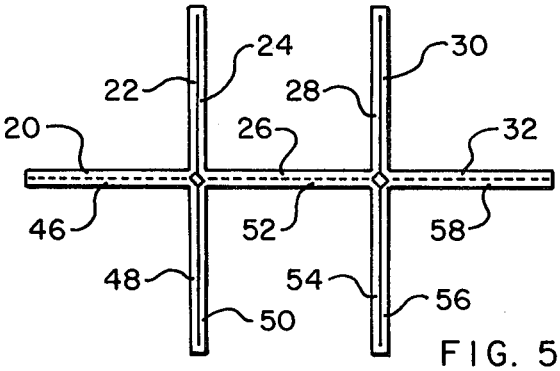
FIG. 5 is a view similar to FIGS. 3 and 4 but with the blank completely opened into the divider position.

As shown in FIGS. 4 and 5 the folded blank of FIGS. 1 and 3 is formed into the divider of FIG. 6 by folding the panels 22 and 24 and the panels 28 and 30 rearward while simultaneously folding the panels 48 and 50 and the panels 54 and 56 frontward so that the panels 22 and 24 are brought face to face, the panels 28 and 30 are brought face to face, the panels 48 and 50 are brought face to face and the panels 54 and 56 are brought face to face to form wings on the divider.

The divider has a double thickness of paperboard only in the lower half of the divider where the panels 20 and 46, the panels 26 and 52, the panels 32 nd 58, the panels 22 and 24, the panels 28 and 30, the panels 48 and 50, and the panels 54 and 56 are face to face. Thus in the upper half of the divider, the walls of the divider have only a single thickness; this reduces the amount of paperboard necessary to form a single piece divider yet provides the necessary double thickness protection between the bottoms of bottles where the protection is needed.

Also the divider may be inverted so that the double thickness of paperboard may be used to separate upper portions of articles if desired.

Since the vertical pairs of corresponding panels in the rear and front series have equal lengths, there is substantially no waste paperboard formed in cutting the divider blanks 10 from the continuous strip 12 as seen in FIG. 2.

Since the invention is subject to many modifications, variations and changes in detail, it is intended that all matter in the foregoing description or shown in the accompanying drawings be interpreted as illustrative and not in a limiting sense.

What is claimed is

1. A one-piece partition for a multiple article carrier comprising front and back series of panels, each of said front and back series of panels having at least four panels hinged together at vertical scorelines, end panels of said front and back series of panels being hinged at horizontal scorelines to the respective end panels of the opposite series of panels, an adjacent pair of panels in each series of panels between the end panels being free of the corresponding adjacent pair of panels of the opposite series of panels, and said front and back series of panels having respective alternating tall and short vertical dimensions wherein the corresponding panel of the opposite series to each tall panel is short.

2. A partition as claimed in claim 1 wherein the tall panels are about twice as long as the short panels.

3. A partition as claimed in claim 1 wherein the end panels of said front and back series of panels are bonded together.

4. A partition as claimed in claim 1 wherein each of the front and back series of panels have at least seven panels hinged together at vertical scorelines, th middle panels of said front and back series of panels are hinged at a horizontal scoreline, a first adjacent pair of panels of each of said front and back series of panels between one respective end panel and the respective middle panel are free of the corresponding first adjacent pair of panels of the opposite series of panels, and a second adjacent pair of panels of each of said front and back series of panels between the other respective end panel and the respective middle panel are free of the corresponding second adjacent pair of panels of the opposite series of panels.

5. A partition as claimed in claim 4 wherein the short panels have a length about one-half the length of the tall panels.

6. A one-piece partition blank for a multiple article carrier comprising a series of at least four elongated panel pairs, said panel pairs having equal lengths, the panels of each panel pair of said panel pairs having inner edges extending along a center line of the partition blank, each panel pair being offset relative to its adjoining panel pair or pairs, respectively, about one-third the combined length of each panel pair, each panel pair being hinged to its adjoining panel pair or pairs, respectively, said series of panel pairs having the panels of each of the end panel pairs hingedly jointed together, and said series of panel pairs having an adjacent pair of panel pairs intermediate the end panel pairs wherein the panels of each panel pair of the adjacent pair of panel pairs are separated by a cut and are free of each other.

7. A partition as claimed in claim 6 wherein the series of panel pairs includes at least seven elongated panel pairs hinged together at their sides, the middle panel pair of said series of panel pairs having the panels thereof joined together, a first adjacent pair of panel pairs of said series of panel pairs intermediate one end panel pair and the middle panel pair being free of each other, and a second adjacent pair of panel pairs of said series of panel pairs between the other end panel pair and the middle panel pair being free of each other.

* * * * *